US008115410B2

(12) United States Patent
Baaijens et al.

(10) Patent No.: US 8,115,410 B2
(45) Date of Patent: Feb. 14, 2012

(54) DEVICE FOR GENERATING LIGHT WITH A VARIABLE COLOR

(75) Inventors: Johannes Petrus Wilhelmus Baaijens, Eindhoven (NL); Cornelis Antonius Verbakel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 429 days.

(21) Appl. No.: 12/517,371

(22) PCT Filed: Dec. 4, 2007

(86) PCT No.: PCT/IB2007/054915

§ 371 (c)(1),
(2), (4) Date: Jun. 3, 2009

(87) PCT Pub. No.: WO2008/068713

PCT Pub. Date: Jun. 12, 2008

(65) Prior Publication Data

US 2010/0084995 A1 Apr. 8, 2010

(30) Foreign Application Priority Data

Dec. 8, 2006 (EP) ..... 06125695

(51) Int. Cl.
*H05B 37/02* (2006.01)

(52) U.S. Cl. ..... 315/291; 315/307; 315/308; 345/601; 345/604

(58) Field of Classification Search ..... 315/291
See application file for complete search history.

(56) References Cited

U.S. PATENT DOCUMENTS

| | | | | |
|---|---|---|---|---|
| 5,254,977 | A | 10/1993 | MacDonald | |
| 5,384,519 | A | 1/1995 | Gotoh | |
| 5,450,216 | A * | 9/1995 | Kasson | 358/518 |
| 6,323,969 | B1 * | 11/2001 | Shimizu et al. | 358/523 |
| 6,366,291 | B1 * | 4/2002 | Taniguchi et al. | 345/603 |
| 6,552,495 | B1 | 4/2003 | Chang | |
| 7,436,996 | B2 * | 10/2008 | Ben-Chorin et al. | 382/167 |
| 7,515,128 | B2 * | 4/2009 | Dowling | 345/83 |
| 7,852,010 | B2 * | 12/2010 | Negley | 315/185 R |
| 2003/0137610 | A1 * | 7/2003 | Ohsawa | 348/744 |
| 2007/0046690 | A1 * | 3/2007 | Madden et al. | 345/590 |

FOREIGN PATENT DOCUMENTS

| | | | |
|---|---|---|---|
| EP | 1113709 | A2 | 7/2001 |
| EP | 1445989 | A1 | 8/2004 |
| WO | 0076291 | A2 | 12/2000 |
| WO | 0135656 | A1 | 5/2001 |
| WO | 2006071628 | A2 | 7/2006 |

* cited by examiner

*Primary Examiner* — Jacob Y Choi
*Assistant Examiner* — Anthony Arpin

(57) ABSTRACT

In an illumination system (10), comprising: a lamp assembly (14) with a plurality of lamps (12A, 12B, 12C) and associated lamp drivers (13A, 13B, 13C); a common controller (15) for generating control signals (ξ1, ξ2, ξ3) for the lamp drivers (13A, 13B, 13C); a memory (18) containing a color table with color points; the color points of the color table are located in a two-dimensional plane corresponding to a ceiling of a color space. Perimeter color points (PC) are located on the borderline of said plane, in groups of equidistant color points, as measured in a perceptual uniform second color space. Equidistant spoke color points (SC) are located on constant hue lines (42) in said plane, constant hue line connecting one of said perimeter color points (PC) to a white point (W).

25 Claims, 4 Drawing Sheets

DEVICE FOR GENERATING LIGHT WITH A VARIABLE COLOR

FIELD OF THE INVENTION

The present invention relates in general to the field of lighting. More particularly, the present invention relates to an illumination device for generating light with a variable color.

BACKGROUND OF THE INVENTION

Illumination systems for illuminating a space with a variable color are generally known. Generally, such systems comprise a plurality of light sources, each light source emitting light with a specific color, the respective colors of the different light sources being mutually different. The overall light generated by the system as a whole is then a mixture of the light emitted by the several light sources. By changing the relative intensities of the different light sources, the color of the overall light mixture can be changed.

It is noted that the light sources can be of different type, such as for instance TL lamp, halogen lamp, LED, etc. In the following, simply the word "lamp" will be used, but this is not intended to exclude LEDs.

By way of an example, in the case of homes, shops, restaurants, hotels, schools, hospitals, etc., it may be desirable to be able to change the color of the lighting. In many situations it is desirable to have smooth and slow transitions, with a fine choice in colors (described with Hue and Saturation) to find easily a desired color with a user interface or to have a comfortable colored atmosphere with not too fast dynamic changes.

As should be clear to a person skilled in the art, the color of light can be represented by coordinates of a color point in a color space. In such representation, changing a color corresponds to a displacement from one color point to another color point in the color space, or a displacement of the setting of the color point of the system. Further, a sequence of colors corresponds to a collection of color points in the color space, which collection will be indicated as a path. Dynamically changing the colors can then be indicated as "traveling" such path. More in general, dynamically changing the colors of lighting will be indicated as "navigating" through the color space.

Typically, an illumination system comprises three lamps of single color, which will also be indicated as the primary lamps generating primary colors. Usually, these lamps are close-to-red (R), close-to-green (G), close-to-blue (B), and the system is indicated as an RGB system. It is noted that illumination systems may have four or more lamps. As a fourth lamp, a white lamp may be used. It is also possible that one or more additional colors are used, for instance a yellow lamp, a cyan lamp, etc. In the following explanation, an RGB system will be assumed, but the invention can also be applied to systems with four or even more colors.

For each lamp, the light intensity can be represented as a number from 0 (no light) to 1 (maximum intensity). A color point can be represented by three-dimensional coordinates ($\xi 1$, $\xi 2$, $\xi 3$), each coordinate in a range from 0 to 1 corresponding in a linear manner to the relative intensity of one of the lamps. The color points of the individual lamps can be represented as (1,0,0), (0,1,0), (0,0,1), respectively. These points describe a triangle in the CIE 1931 (x,y) color space. All colors within this triangle can be generated by the system.

In theory, the color space can be considered as being a continuum. In practice, however, a controller of an illumination system is a digital controller, capable of generating discrete control signals only. When a user wishes to navigate through the color space with a system comprising such digital controller, he can only take discrete steps in the direction of one of the coordinates. A problem is that the RGB color space is not a linear space, so that, when taking a discrete step of a certain size along one of the color intensity coordinate axes, the amount of color change perceived by the user is not constant but depends on the actual position within the color space.

In order to solve this problem, different representations of the color space have been proposed, such as the CIELAB color space, where the independent variables are hue (H), saturation (S; in CIELAB calculated with S=Chroma/Lightness), brightness (B; in CIELAB calculated from Lightness). Because of the perceptual uniformity of Lightness (i.e. a linear change of Lightness level is also perceived as a linear change of light intensity level by the user), it is advantageous to use this parameter instead of Brightness. However, to generalize the description the parameter "Brightness" will be used in the explanation next, which values are also described with a perceptual uniform distribution (e.g. in u'V'Y space, with "Y" describing intensity, perceptual uniform Brightness distribution is logarithm(Y)). The CIELAB color space can be seen as a three-dimensional space of discrete points (3D grid). Each point in this space can be represented by coordinates m, n, p, and in each point the hue (H), saturation (S), Brightness (B) have specific values H(m,n,p), S(m,n,p), B(m,n,p), respectively. A user can take a discrete step along any of the three coordinate axes, resulting in predefined and constant changes in hue, saturation or Brightness, respectively, as long as the color is inside the outer boundary of the color gamut as defined by the primary lamps. In principle, the variables hue, saturation and Brightness are independent from each other. However, not all combinations of possible values for hue, saturation and Brightness correspond to physically possible colors. In a state of the art implementation, the system comprises three 3D lookup tables for hue, saturation and Brightness, respectively. With such 3D lookup tables, an advantage is that it is easily possible to consider, for each combination of m, n, and p, whether or not the resulting combination of H, S and B corresponds to a physically possible color, and to enter a deviating value in the tables if necessary. For memory locations where the combination of H, S and B would result in physically impossible colors, the tables may contain a specific code, or they may contain values of a different color, for instance the closest value of the color space boundary.

A problem, however, is that such solution with 3D lookup tables requires a relatively large amount of memory space. In an exemplary situation, the system allows for independent setting of the brightness in 25 possible brightness levels, the saturation in 75 possible saturation levels, and the hue in 200 possible hue values. In such situation, the system requires 3*200*75*25=1125000 memory locations (over 1 MByte).

The invention aims to reduce the amount of memory space needed, so that low cost microcontrollers with limited memory space can be used. A further objective of the invention is to provide a more efficient manner of generating a color table, and a color navigation device equipped with such color table, allowing for a simple navigation method through the color space along lines of constant Hue, constant Saturation or constant relative Brightness (at a certain color point (x,y) in the color space CIE1931, the relative brightness is a percentage (or a factor between 0 and 1) of the maximum absolute Brightness that is possible at that color point).

SUMMARY OF THE INVENTION

According to an important aspect of the present invention, a two-dimensional color table is defined, effectively mapping the upper surfaces of the three-dimensional color space. The two coordinates of the color points in the table are hue and saturation. Color points having the same hue are defined such that the intervals between successive color points are substantially equal, as measured in a perceptually uniform color space, for instance the L*a*b* space. As a result, when stepping from one color point to the next along a line of constant hue, a user will perceive equal changes in saturation. Along the boundary of the color space (i.e. maximum saturation), between the primary colors, certain specific intermediate color points are predefined such as to make sure that those specific colors can be produced by the system. Between two neighboring primary colors, there is always defined at least one specific intermediate color point. Along each section of the color space boundary, between a primary color and the neighboring intermediate color point or between two neighboring intermediate color points, the color points are defined such that the intervals between successive color points are substantially equal, as measured in the same perceptually uniform color space. The number of color points along the respective sections may be chosen such as to give certain sections more weight as compared to others, as desired. A table accommodating 32 levels of hue and 8 levels of saturation, which requires only 256 memory locations, was found to be adequate; however, a more fine color distribution is also possible; particularly, the number of Hue steps can be larger, and can for instance be high as 90. Changing the brightness (dimming) can simply be performed by a controller by multiplying the RGB-values with a factor between 0 and 1.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
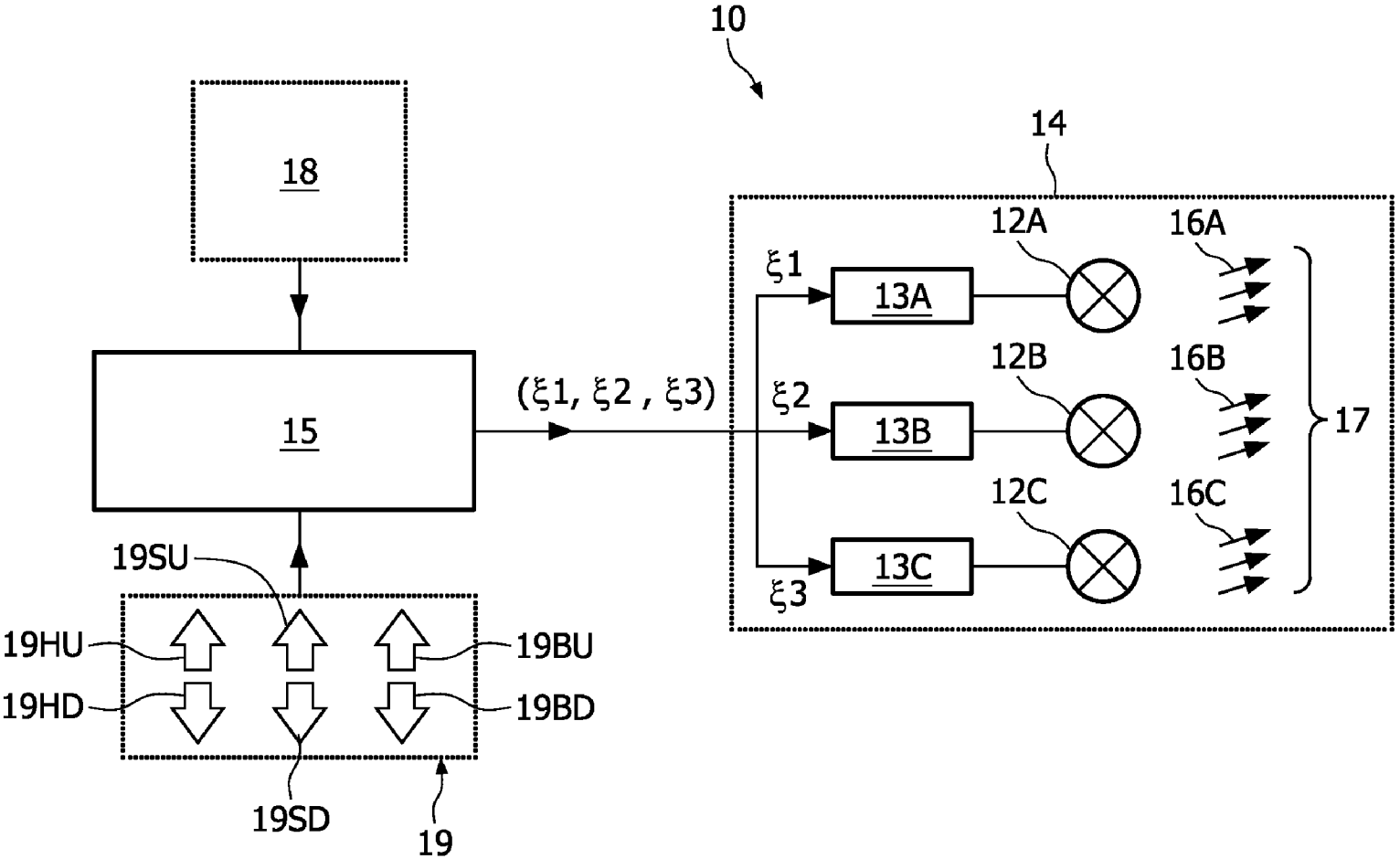
FIG. 1 schematically shows a block diagram of an illumination system according to the present invention.

FIG. 1 schematically shows a block diagram of an illumination system 10, comprising a lamp assembly 14. The lamp assembly 14 comprises a plurality (here: three) of lamps 12A, 12B, 12C, for instance LEDs, each with an associated lamp driver 13A, 13B, 13C, respectively, controlled by a common controller 15. A user input device is indicated at 19. The three lamps 12A, 12B, 12C generate light 16A, 16B, 16C, respectively, with mutually different light colors; typical colors used are red (R), green (G), blue (B). Instead of pure red, green and blue, the lamps will typically emit light close-to-red, close-to-green and close-to-blue. The overall light emitted by the lamp assembly 14 is indicated at 17; this overall light 17, which is a mixture of individual lights 16A, 16B, 16C, has a color determined by the mutual light intensities LI(R), LI(G), LI(B) of the primary lamps 12A, 12B, 12C, which in turn are determined by control signals ξ1, ξ2, ξ3 generated by the controller 15 for the respective drivers 13A, 13B, 13C. The respective intensities LI(R), LI(G), LI(B) can be considered as three-dimensional coordinates in an RGB-color space.

Figure 2:
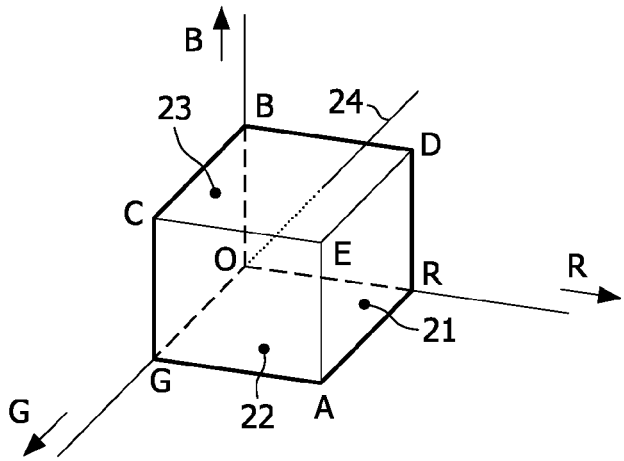
FIG. 2 is a diagram schematically illustrating a three-dimensional RGB-color space.

FIG. 2 is a diagram schematically illustrating such three-dimensional RGB-color space. The three orthogonal axes are indicated as R, G, B, respectively. Each axis may represent the actual light intensity of one of the lamps 12A, 12B, 12C, for instance in lumen, but it is customary to use normalized axes wherein the corresponding coordinates can have values between 0 and 1 only, indicating the relative lamp power of the corresponding lamp, which can be varied between OFF (0) and maximum (1). In this respect it is noted that it is customary to operate a LED with a selected fixed lamp current, that is switched ON and OFF at a predetermined switching frequency, so that the duty cycle (i.e. the ratio between ON time and switching period) determines the average lamp power. Thus, the values along the three orthogonal axes in FIG. 2 may also be considered as representing the duty cycle of the drive signals for the corresponding lamps. These values will be indicated as X, Y, Z, with values between 0 and 1.

In FIG. 2, the colors which can be made with this system 10 are confined within a cube 20 having corner points O(0,0,0), R(1,0,0), G(0,1,0), B(0,0,1). Further corner points are indicated A(1,1,0), D(1,0,1), C(0,1,1) and E(1,1,1). The cube 20 has six boundary planes, of which three planes will be indicated as "maximum planes": a first maximum plane 21 RDEA comprises all colors where the red contribution is maximal, a second maximum plane 22 GAEC comprises all colors where the green contribution is maximal, and a third maximum plane 23 BCED comprises all colors where the blue contribution is maximal. Lines through the origin, for instance line 24, comprise all color points with the same color yet different brightness; the intersection of such line with one of the maximum planes defines the maximum brightness possible for that color.

The opposite three planes will be indicated as "minimum planes": these are the planes through O. The intersection of the three maximum planes with the three minimum planes, i.e. the closed line RAGCBDR, comprises all points having maximum saturation, and will be indicated as color space boundary curve, abbreviated as CSB curve.

It is possible to make a transformation to a coordinate system where the brightness is an independent coordinate. Such system is for instance the CIE 1931 coordinate system, having coordinates x, y, Y, wherein x and y are chromaticity coordinates and wherein capital Y indicates brightness. The transformation regarding the color coordinates is defined by the following formulas:

$$x = \frac{X}{X+Y+Z} \tag{1a}$$

$$y = \frac{Y}{X+Y+Z} \tag{1b}$$

$$z = \frac{Z}{X+Y+Z} = 1 - x - y \tag{1c}$$

Figure 3:
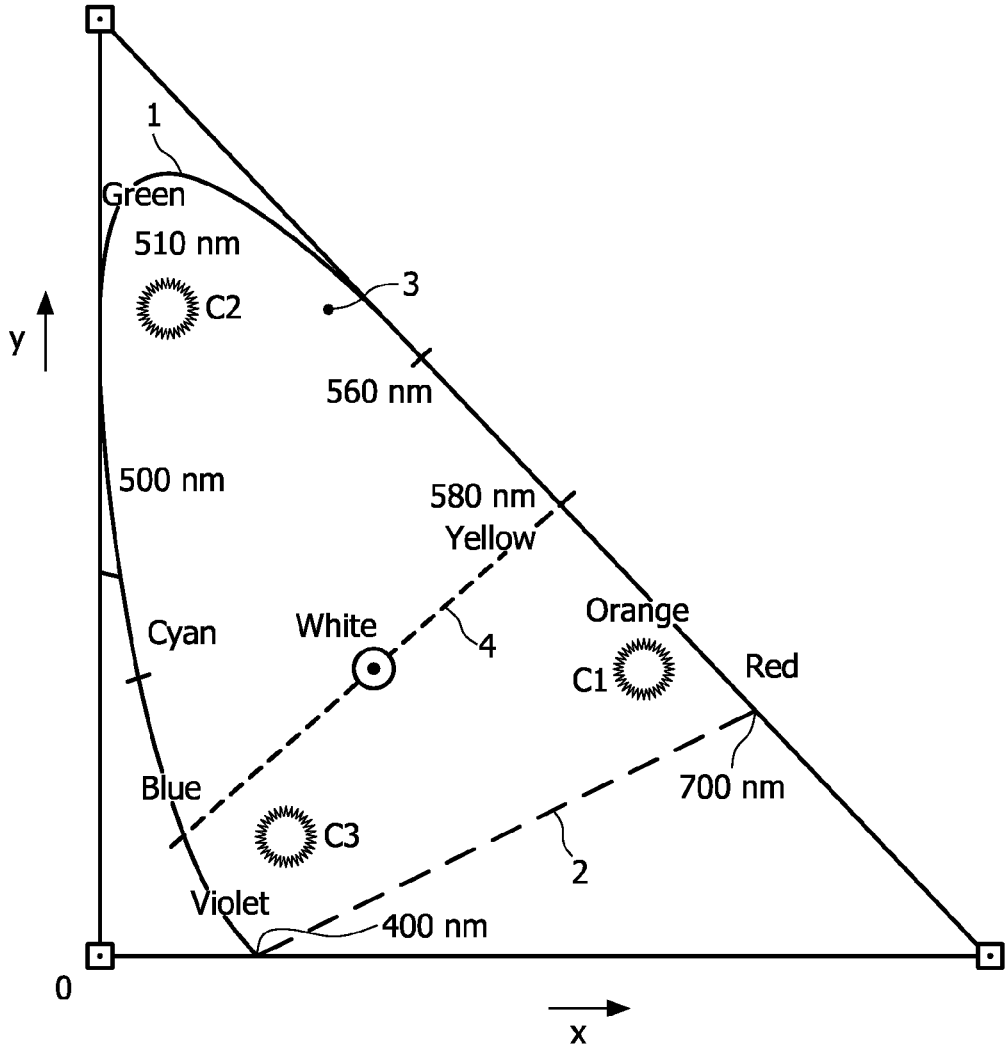
FIG. 3 schematically shows a chromaticity diagram.

Thus, all colors can be represented in a two-dimensional xy-plane, as shown in FIG. 3, which schematically shows a CIE(xy) chromaticity diagram. This diagram is well-known, therefore an explanation will be kept to a minimum. Points (1,0), (0,0), and (0,1) indicate ideal red, blue and green, respectively, which are virtual colors. The curved line 1 represents the pure spectral colors. Wavelengths are indicated in nanometers (nm). A dashed line 2 connects the ends of the curved line 1. The area 3 enclosed by the curved line 1 and dashed line 2 contains all visible colors; in contrast to the pure spectral colors of the curved line 1, the colors of the area 3 are mixed colors, which can be obtained by mixing two or more pure spectral colors. Conversely, each visible color can be represented by coordinates in the chromaticity diagram; a point in the chromaticity diagram will be indicated as a "color point".

It is noted that the two-dimensional representation of FIG. 3 corresponds to all colors having the same brightness. For different brightnesses, the shape of the lines 1 and 2 may be different. The brightness may be taken as a third axis perpendicular at the plane of drawing of FIG. 3. All two-dimensional curves together, stacked according to brightness, define a curved three-dimensional body. In other words, the chromaticity diagram of FIG. 3 is a two-dimensional cross-section of the three-dimensional color space. It is further noted that boundary planes in the RGB representation transform to boundary planes in the x, y, Y representation. Particularly, the above-mentioned maximum surfaces 21, 22, 23 transform to three maximum planes in the x, y, Y representation, which together define an "upper" boundary of the three-dimensional color space, assuming that the third axis for brightness is taken as a "vertical" axis and the coordinates x and y are considered as defining a "horizontal" plane. Said "upper" boundary of the three-dimensional color space will hereinafter be indicated as the "ceiling" of the color space.

The basic concepts of Hue, Saturation and Brightness are most easily explained in the CIE 1931 (x,y) color space, referring to FIG. 3, although in other color spaces other definitions can be obtained. For simplicity, we use CIE 1931 (x,y) color space next. When two pure spectral colors are mixed, the color point of the resulting mixed color is located on a line connecting the color points of the two pure colors, the exact location of the resulting color point depending on the mixing ratio (intensity ratio). For instance, when violet and red are mixed, the color point of the resulting mixed color purple is located on the dashed line 2. Two colors are called "complementary colors" if they can mix to produce white light. For instance, FIG. 3 shows a line 4 connecting blue (480 nm) and yellow (580 nm), which line crosses a white point, indicating that a correct intensity ratio of blue light and yellow light will be perceived as white light. The same would apply for any other set of complementary colors: in the case of the corresponding correct intensity ratio, the light mixture will be perceived as white light. It is noted that the light mixture actually still contains two spectral contributions at different wavelengths.

If the light intensity of two complementary colors (lamps) is indicated as I1 and I2, respectively, the overall intensity Itot of the mixed light will be defined by I1+I2, while the resulting color will be defined by the ratio I1/I2. For instance, assume that the first color is blue at intensity I1 and the second color is yellow at intensity I2. If I2=0, the resulting color is pure blue, and the resulting color point is located on the curved line 1. If I2 is increased, the color point travels the line 4 towards a white point. As long as the color point is located between pure blue and white, the corresponding color is still perceived as blue-ish, but closer to the white point the resulting color would be paler.

In the following, the word "color" will be used for the actual color in the area 3, in association with the phrase "color point". The "impression" of a color will be indicated by the word "hue"; in the above example, the hue would be blue. It is noted that the hue is associated with the spectral colors of the curved line 1; for each color point, the corresponding hue can be found by projecting this color point onto the curved line 1 along a line crossing the white point.

Further, the fact whether a color is a more or less pale hue will be expressed by the phrase "saturation". If a color point is located on the curve 1, the corresponding color is a pure spectral color, also indicated as a fully saturated hue (saturation=1). As the color point travels towards the white point, the saturation decreases (less saturated hue or paler hue); in the white point, the saturation is zero, per definition.

It is noted that many visible colors can be obtained by mixing two colors, but this does not apply for all colors, as can easily be seen from FIG. 3. With three lamps producing three different colors, it is possible to produce light having any desired color within the triangle defined by the three corresponding color points. More lamps may be used, but that is not necessary. For instance, it is also possible to add a white light lamp. Or, if it is desired to produce a color outside said triangle, a fourth lamp having a color point closer to the desired color may be added. Inside said triangle, colors are now no longer obtained as a unique combination of three light outputs but can be obtained in several different ways as combination of four light outputs.

In FIG. 3, three exemplary color points C1, C2, C3 indicate respective colors close-to-red, close-to-green and close-to-blue, of the three lamps 12A, 12B, 12C. With the system 10, it is possible to set the mixture color of the output light mixture 17 at any desired location within the triangle defined by said points C1, C2, C3, if it is possible to vary said control signals ξ1, ξ2, ξ3 continuously. Typically, however, a user requires a functionality that allows him to change the colors in discrete steps. To that end, the controller 15 is provided with a memory 18 containing a color table. Each entry in this table corresponds to a specific color point in the CIE 1931 color space, and contains the corresponding control signals ξ1, ξ2, ξ3. If the user selects a certain color point, the controller 15 reads the corresponding values for the control signals ξ1, ξ2, ξ3 from the table and uses these values for controlling the drivers 13A, 13B, 13C, which results in the mixed light 17 having the color desired by the user. In such case, the attainable color points are located along a grid in the color space.

The table is organized in such a way that the user can easily navigate through color space along lines of constant hue, constant saturation or constant brightness, in a stepwise manner. The user input device 19 is of a type allowing the user to input, for instance, step-up and step-down commands for increasing or decreasing the hue by one step, which has the result that the controller 15 will take from the memory 18 the first color point located next to the current color point in the hue direction. The user input device 19 also allows the user to input step-up and step-down commands for increasing or decreasing the saturation by one step, which has the result that the controller 15 will take from the memory 18 the first color point located next to the current color point in the saturation direction. For sake of simplicity, this is visualized in FIG. 1 by showing the user controller 19 having up/down buttons 19HU, 19HD for hue, up/down buttons 19SU, 19SD for saturation, and up/down buttons 19BU, 19BD for brightness.

In prior art, it is customary to have a three-dimensional color table, the third dimension being for brightness. If the user inputs a step-up or step-down command for increasing or decreasing the brightness by one step, the controller 15 will take from the memory 18 the first color point located next to the current color point in the brightness direction. However, this requires much memory space. The present invention provides a solution allowing the same functionality over the entire color space while requiring only a relative small amount of memory space, and to an efficient method for generating such table. The present invention further provides an illumination system comprising such table.

According to a first aspect of the present invention, the color table in memory 18 is a two-dimensional color table, and only contains color points located on the ceiling of the color space in CIE xyY representation. These color points, which will be indicated as the maximum color points in view of the fact that they are located on the maximum boundary surfaces and therefore represent the maximum brightness attainable for that specific hue and saturation, are arranged along a grid defined by orthogonal lines of constant hue and constant saturation; here saturation is used as a relative value: the distance from the white point to the color point divided by the maximum distance from the white point to the color space boundary CSB at the same Hue in CIE1931 x,y space. The way the saturation distances are computed is explained below. The corresponding control signals $\xi 1$, $\xi 2$, $\xi 3$ stored in said table for these maximum color points will be indicated as $\xi 1m$, $\xi 2m$, $\xi 3m$, respectively. It should be clear that at least one of these values is always equal to 1.

According to a second aspect of the present invention, the controller 15 sets the brightness of a color point by multiplying the values $\xi 1m$, $\xi 2m$, $\xi 3m$ obtained from the memory 18 by a common multiplying factor $\alpha$ having a value between 0 and 1. Thus, the control signals $\xi 1$, $\xi 2$, $\xi 3$ to be outputted are calculated as $\xi 1=\alpha\cdot\xi 1m$, $\xi 2=\alpha\cdot\xi 2m$, $\xi 3=\alpha\cdot\xi 3m$.

It is possible for the controller 15 to continuously vary the brightness by letting $\alpha$ have any value in the range from 0 to 1. However, it is preferred that the brightness is also changed in a stepwise manner. Therefore, in a possible embodiment, $\alpha$ is calculated according to $\alpha=n/Nb$, wherein Nb is an integer defining the number of brightness levels, and wherein n is an integer in the range from 0 to Nb. It is possible that n is always calculated, but it is also possible that the allowable values of $\alpha$ are stored in a brightness factor memory, which would require Nb+1 memory locations.

However, it is noted that "perceived brightness" relates to "actual brightness" in a logarithmic way, which means that if the brightness levels are equidistant this will not result in perceptual uniform brightness steps. Since the perceived brightness steps are more important than the actual brightness steps, $\alpha$ is preferably calculated according to the following formula:

$$\alpha = 10^{\left(\frac{i-1}{(Nb-1)/Nd}-Nd\right)} \tag{2}$$

wherein i is an integer in the range from 1 to Nb,
and wherein Nd indicates the number of decades between the maximum brightness level and the minimum brightness level.

In a suitable embodiment, Nd is equal to 2, in which case a ranges from 0.01 to 1.

Formula (2) implies a constant factor between successive values of $\alpha$.

Again, it is possible that $\alpha$ is always calculated, but it is also possible that the allowable values of $\alpha$ according to formula (2) are stored in the brightness factor memory, which would require Nb memory locations.

If the controller 15 receives from the user input 19 a hue step-up or hue step-down command signal for increasing or decreasing the hue by one step, the controller 15 will take from the memory 18 the first color point located next to the current color point in the hue direction. If the controller 15 receives from the user input 19 a saturation step-up or saturation step-down command signal for increasing or decreasing the saturation by one step, the controller 15 will take from the memory 18 the first color point located next to the current color point in the saturation direction. If the controller 15 receives from the user input 19 a brightness step-up or brightness step-down command signal for increasing or decreasing the brightness by one step, the controller 15 will increase or decrease n by 1, or take from the memory 18 the first brightness factor located in the brightness factor memory at the memory location next to the memory location of the current brightness factor. It is repeated that "brightness" here means "relative brightness".

A third aspect of the present invention relates to the distribution of the color points in the table over the ceiling of the color space. It is possible to use equidistant color points in the xyY space, but a disadvantage would be that steps would not be perceived by the user as resulting in color changes of the same magnitude.

The present invention also aims to solve this problem. Particularly, the present invention aims to provide a method for defining the maximum color points in the two-dimensional color table which method allows the designer more freedom to accommodate certain wishes.

The solution offered by the present invention will be explained with reference to FIGS. 4A-4B, which schematically show a top view of the ceiling 40 of the color space. The outer perimeter of the ceiling corresponds to the CSB curve mentioned earlier, and is therefore indicated as CSB curve as well, indicated by reference numeral 41. In this explanation, it will be assumed that the system 10 has three light sources, as illustrated in FIG. 1, but it is noted that the explanation also applies to systems having four or more light sources.

In a first step, the color points C1, C2, C3 of the light sources are determined, and the maximum intensities of these light sources are determined. It is noted that these parameters depend on the actual light sources, and in turn they define the shape of the ceiling 40 and the CSB curve 41. It is noted that the color points C1, C2, C3 are always located on the CSB curve 41. In the example, C1, C2, C3 correspond to red, green and blue, respectively. In view of the fact that these color points correspond to the light sources, they will also be indicated as "primary" color points.

In a second step, a predetermined number of intermediate color points are defined for at least one pair of neighboring primary color points, those intermediate color points being located on the CSB curve 41 between said pair of neighboring primary color points. By way of example, FIG. 4A shows one intermediate color point IC1(12) between C1 and C2, one intermediate color point IC2(23) between C2 and C3, and one intermediate color point IC3(31) between C3 and C1. The number of intermediate color points between any pair of neighboring primary color points may be 2 or higher, but it is not desirable to choose this number to be too high: a practical upper limit seems to be 5.

In the example, one intermediate color point is defined between each pair of neighboring primary color points, but this is not essential: it may be that there is at least one intermediate color point between each pair of neighboring color points.

In the example, the number of intermediate color points is always the same for each pair of neighboring primary color points, but this is not essential: it may be that these numbers are different for different pairs.

The exact location of an intermediate color point is basically a matter of design freedom. In a particular embodiment, an intermediate color point is always located midway between the corresponding primary color points, measured along the CSB curve 41 of FIG. 4A. In another particular embodiment, an intermediate color point corresponds to a certain predefined color or a certain predefined (xy)-coordinate; for instance, the intermediate color points may correspond to yellow, cyan and magenta.

Figure 4A:
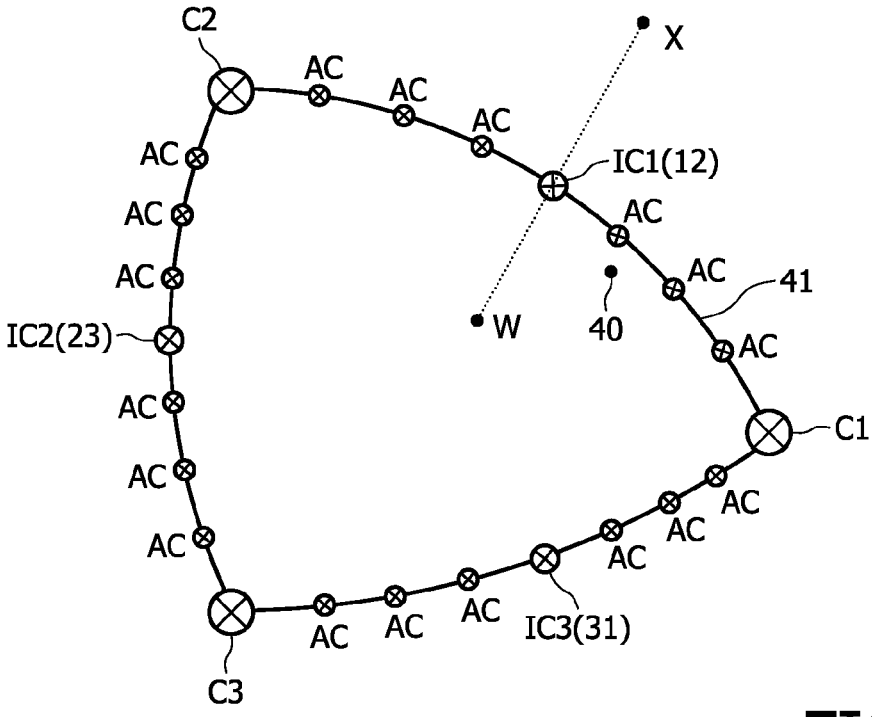
FIGS. 4A-4D illustrate a method for calculating color points for a color table.

Together, the primary color points and the intermediate color points divide the CSB curve 41 into curve sections; in the embodiment of FIG. 4A, there are six such curve sections.

It is noted that an intermediate color point may be defined by selecting a certain color point X outside (or inside) the CSB curve (for instance a monochromatic color point located on the boundary of maximum saturation in the CIE31(x,y) color space), and projecting this color point X on the CSB curve 41 along a line through a white point W. This is illustrated for IC1(12).

In a third step, each curve section is subdivided into a plurality of segments. The number of segments may be equal for each curve section, but that is not essential. In the example of FIG. 4A, each curve section is subdivided into 4 segments, which involves defining 3 auxiliary color points AC on each curve section, between the corresponding primary color points C1, C2, C3 and/or intermediate color points IC1, IC2, IC3. For each curve section, these auxiliary color points AC are defined such that the corresponding segments have mutually substantially equal lengths (i.e. the color points have mutually substantially equal distances). For measuring this, a perceptual uniform space is used, for instance the CIELAB color space, also referred to as the L*a*b* color space. Alternatively, the u'v'Y space may be used.

It is noted that the L*a*b* color space is well known to a person skilled in the art so that an elaborate discussion can be omitted. For sake of completeness, it is noted that in the L*a*b* color space the distance ΔE between two color points is expressed by the following formula:

$$\Delta E=\sqrt{(\Delta L^*)^2+(\Delta H^*)^2+(\Delta C^*)^2} \quad (3)$$

wherein ΔC indicates the chroma difference between those two color points, chroma being defined as the product of saturation and lightness;

and wherein $\Delta H=\overline{C}^*\Delta h^*$, with $\overline{C}^*$ being the arithmetic mean of the two chroma values of those two color points, and Δh* being the hue angle difference between those two color points.

It is noted that the value of the lengths of the segments in one curve section may be different from the value of the lengths of the segments in another curve section.

Based on experience, to improve the color table the following formula's are used.

1) Along lines of constant Hue at maximum Brightness:

$$\Delta E=\Delta C^* \quad (4)$$

2) Along: lines of maximum Saturation and maximum Brightness (at boundary CSB):

$$\Delta E=\sqrt{(\Delta H^*)^2+(\Delta C^*)^2} \quad (5)$$

In a fourth step, a white point W is selected within the color space boundary line 41, i.e. a point on the black body line. Here, the designer has some design freedom as to select the color temperature of the white point W, but this color temperature is preferably selected in the range 2500 K to 7000 K, preferably at the maximum Brightness that is possible with that color. Preferably, this white point is the same white point as used for defining CIELAB coordinates and CIELAB color differences. It is further preferred that this white point corresponds to the apex [R,G,B]=[1,1,1] of the color space.

Alternatively, it is possible to use a white point such that the average distance to the primary color points, or to the combination of primary color points and intermediate color points, is minimal.

Figure 4B:
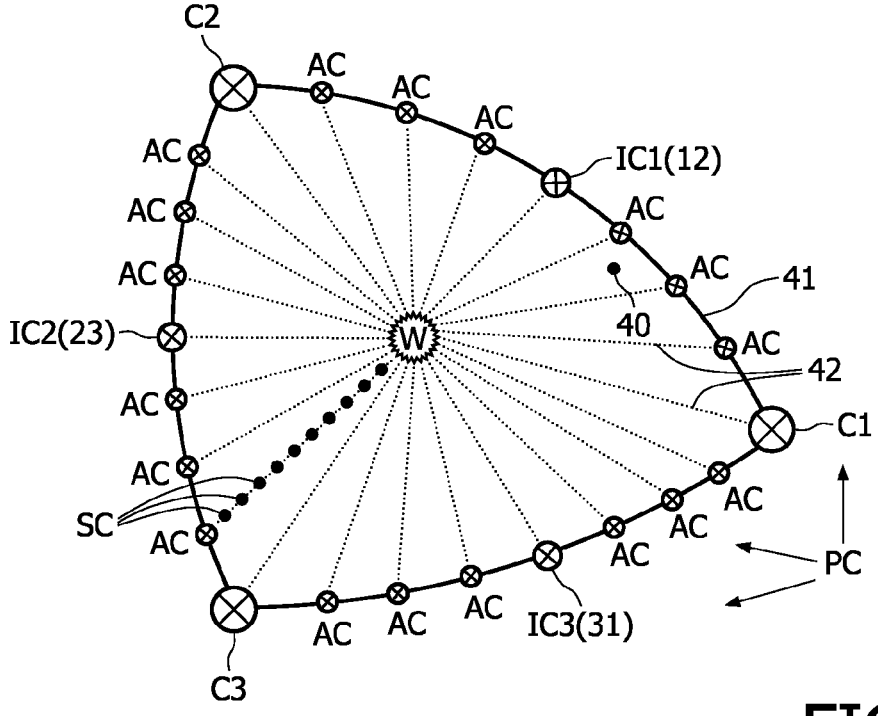

In a fifth step, illustrated in FIG. 4B, lines 42 of constant hue are defined, located in the ceiling 40 plane, which lines 42 connect the white point W with a corresponding one of the color points defined on the CSB curve 41. This applies to the primary color points C as well as to the intermediate color points IC as well as to the auxiliary color points AC. Since the ceiling 40 is curved, said lines 42 are curved, but they are shown as straight lines in FIG. 4B. These lines 42 are equidistant in CIELAB space.

In a sixth step, each constant hue line 42 is provided with a fixed number of equidistant color points, wherein the perceived color distance between those color points is again calculated using the above formula (3). As mentioned above, ΔE=ΔC* is constant. In view of the fact that the constant hue lines 42 extend as spokes in a wheel from the white point W to the perimeter CSB, these lines are also indicated as spoke lines and these color points are also indicated as spoke color points SC. In contrast, the color points located on the perimeter CSB will also be indicated as perimeter color points PC. For sake of simplicity, FIG. 4B shows the spoke color points SC for one of the constant hue lines 42 only.

It is noted that, in respect of each constant hue line 42, the distance between the spoke color point SC having the highest saturation and the corresponding adjacent perimeter color point PC is also equal to the same constant ΔE=ΔC*. The distance between the spoke color point SC having the lowest saturation and the white point W may also be equal to the same constant, but this spoke color point SC may be quite close to the white point W if the number of spoke color points SC is relatively high, in which case traveling a line of constant saturation close to the white point W may lead to color steps that are so small that they are not noticeable for a user, which may be annoying to a user who expects to see color variations. In order to prevent this, the spoke color point SC closest to the white point W may have a distance to this white point W larger than the equal mutual distances between the spoke color points SC of the same constant hue line.

Figure 4C:
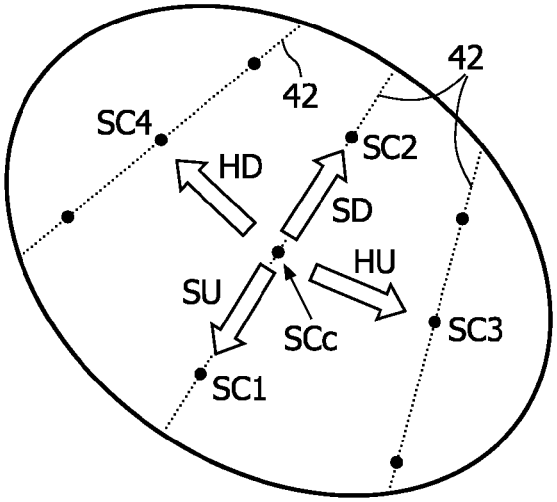

FIG. 4C on a larger scale shows a portion of the ceiling plane 40, with portions of three adjacent spoke lines 42 with their spoke color points SC. A current spoke color point is indicated at SCc. An arrow SU indicates a step to an adjacent spoke color point SC1 in response to a saturation step-up user command. An arrow SD indicates a step to an adjacent spoke color point SC2 in response to a saturation step-down user command. An arrow HU indicates a step to a spoke color point SC3 on an adjacent spoke line in response to a hue step-up user command. An arrow HD indicates a step to a spoke color point SC4 on an adjacent spoke line in response to a hue step-down user command.

Figure 4D:
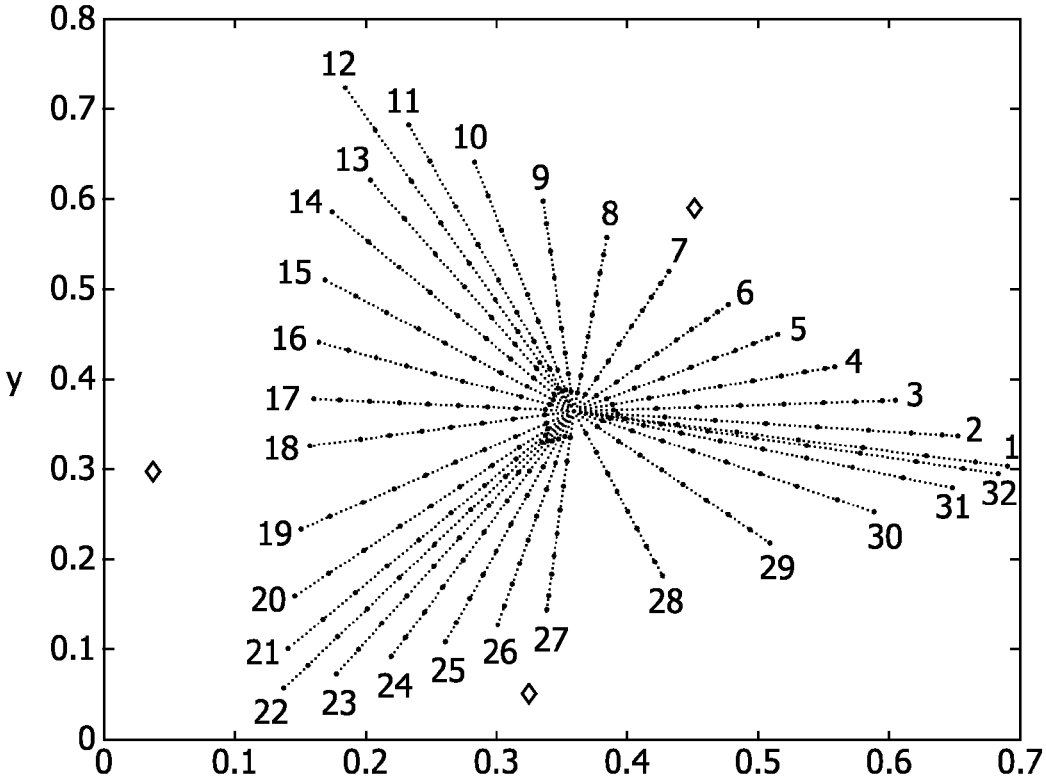

FIG. 4D is a graphical representation in CIE31(x,y) of an actual color table obtained with the method described above. There are 32 color points on the CSB curve 41, thus 32 constant hue lines 42 each having 10 color points SC. The white point W has color temperature 4500 K. There are three intermediate color points, defined by the monochromatic color points yellow, cyan, magenta, indicated by diamond symbols.

Summarizing, the present invention provides an illumination system 10, comprising:

a lamp assembly 14 with a plurality of lamps 12A, 12B, 12C and associated lamp drivers 13A, 13B, 13C;

a common controller 15 for generating control signals ξ1, ξ2, ξ3 for the lamp drivers 13A, 13B, 13C;

a memory 18 containing a color table with color points;

wherein the color points of the color table are located in a two-dimensional plane corresponding to a ceiling of a color space. Perimeter color points PC are located on the borderline of said plane, in groups of equidistant color points, as measured in a perceptual uniform second color space. Equidistant spoke color points SC are located on constant hue lines 42 in said plane, constant hue line connecting one of said perimeter color points PC to a white point W.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, it is possible that the number of colored lamps is larger than three, and that the number of intermediary color points is larger than one. For instance, in the case of RGBA, the apex of the color space can be denoted as [1 1 1 1], but in case of RGBW it is preferred to use [0 0 0 1].

Further, it is noted that a tolerance on the distances measured in the second color space is defined as ΔE=3 in CIELAB coordinates.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Method for generating a table of color points associated with a system of three or more light sources, the method comprising the steps of: in a first color space, determining a ceiling plane as the collection of all color points where at least one of said light sources has maximum intensity, the first color space being a color space in which brightness is an independent coordinate; determining the boundary curve of said ceiling plane; determining the primary color points of said light sources on said boundary curve; in respect of at least one pair of neighboring primary color points, defining a predetermined number of intermediate color points located on the said boundary curve between said pair of neighboring primary color points, thus dividing the said boundary curve into curve sections; in respect of each boundary curve section, defining a predetermined number of auxiliary color points located on the said boundary curve section, such that these auxiliary color points divide the said boundary curve section into curve segments of mutually equal lengths as measured in a perceptual uniform second color space; selecting a white point; defining a plurality of spoke lines of constant hue, located in the said ceiling plane, each spoke line connecting the white point with a corresponding one of the color points defined on the said boundary curve; in respect of each spoke line, defining a predetermined number of spoke color points located on the said spoke line, these spoke color points being equidistant as measured in the said second color space.

2. Method according to claim 1, wherein the first color space is the CIE 1931 (x,y,Y) space.

3. Method according to claim 1, wherein the second color space is the CIELAB color space.

4. Method according to claim 1, wherein the second color space is the u'v'Y color space.

5. Method according to claim 1, wherein said predetermined number of intermediate color points between a pair of neighboring primary color points is in the range from 1 to 5.

6. Method according to claim 1, wherein at least one intermediate color point is defined between each pair of neighboring primary color points.

7. Method according to claim 1, wherein the number of intermediate color points is the same for each pair of neighboring primary color points.

8. Method according to claim 1, wherein an intermediate color point is always located midway between the corresponding primary color points, measured along the said boundary curve.

9. Method according to claim 1, wherein an intermediate color point is defined via projection of a desired color point, given as x,y coordinates in CIE1931 space, onto the said boundary curve along a line through the white point and this desired color point.

10. Method according to claim 9, wherein at least one desired color point is chosen from the group consisting of cyan, magenta, yellow.

11. Method according to claim 1, wherein the number of auxiliary color points is the same for all boundary curve sections.

12. Method according to claim 1, wherein the white point is selected such that its color temperature is in the range 2500 K to 7000 K and its brightness is at the maximum value that is possible at this color with this light source or at the Brightness value of this light source with all primaries at maximum output.

13. Method according to claim 1, wherein the white point is the same white point as used for defining coordinates and color differences in the second color space.

14. Method according to claim 1, wherein the white point corresponds to the apex ([R,G,B]=[1,1,1]) of the color space.

15. Method according to claim 1, wherein the white point is selected such that its average distance to the primary color points is minimal; wherein the distances are measured in the second color space along the linear curves defined in the first color space and with a tolerance Δ.E=3 in CIELAB coordinates.

16. Method according to claim 1, wherein the white point is selected such that its average distance to the combination of primary color points and intermediate color points is minimal; wherein the distances are measured in the second color space along the linear curves defined in the first color space and with a tolerance ΔE=3 in CIELAB coordinates.

17. Method according to claim 1, wherein the number of spoke color points is the same for each spoke line.

18. Method according to claim 1, wherein the distance between the white point and the spoke color point having the lowest saturation is larger than the equal mutual distances between the spoke color points of the same spoke line.

19. Illumination system, comprising: a lamp assembly with a plurality of lamps and associated lamp drivers, the lamp assembly being configured for producing a light mixture consisting of light output contributions of the individual lamps; a common controller for generating control signals for the lamp drivers based on a set of color points generated by the method of claim 1; a user input device for inputting command signals to the controller; a memory associated with the controller, the memory containing a color table including the set of color points, each entry in the table containing a set of corresponding maximum control signals for the lamp drivers in order to let the overall light output mixture have the maximum possible intensity at the corresponding color point.

20. Illumination system according to claim 19, wherein the user input device is capable of generating a command signal identifying hue, saturation and brightness of a desired color setting; wherein the controller, in response to receiving such user command signal, is configured to read from said memory the maximum control signals on the basis of the hue and saturation information in said user command signal, to determine a multiplication factor (α.) on the basis of the brightness information in said user command signal, to calculate output control signals by multiplying said maximum control signals by said multiplication factor (α), and to issue the thus calculated output control signals for controlling the drivers.

21. Illumination system according to claim 20, wherein the user input device is capable of generating a saturation step-up/step-down command for increasing/decreasing the saturation by one step; and wherein the controller, in response to receiving a saturation step-up/step-down user command, is configured to replace the maximum control signals of the current color point (SCc) by the maximum control signals of the first color point (SC1; SC2) located adjacent to the current color point (SCc) on the same spoke line.

22. Illumination system according to claim 20, wherein the user input device is capable of generating a hue step-up/step-down command for increasing/decreasing the hue by one step; and wherein the controller, in response to receiving a hue step-up/step-down command, is configured to replace the maximum control signals of the current color point (SCc) by the maximum control signals of the color point (SC3; SC4) located adjacent to the current color point (SCc) on the first adjacent spoke line.

23. Illumination system according to claim 20, wherein the user input device is capable of generating a brightness step-up/step-down command for increasing/decreasing the brightness by one step; and wherein the controller, in response to receiving a brightness step-up/step-down command, is configured to increase/decrease said multiplication factor (α).

24. Illumination system according to claim 23, wherein controller is configured to calculate an increased/decreased value of said multiplication factor (α) by multiplying the current value of the multiplication factor (α) by a constant factor.

25. Illumination system according to claim 23, wherein the memory contains a table of allowed values for said multiplication factor (α), and wherein controller is configured to obtain an increased/decreased value of said multiplication factor (α) by reading from said table the next allowable value of said multiplication factor (α).

* * * * *